US005465873A

United States Patent [19]

Mejean et al.

[11] Patent Number: 5,465,873

[45] Date of Patent: Nov. 14, 1995

[54] POT FOR THE METERED DISPENSING OF A FLUID SUBSTANCE

[75] Inventors: Pascal Mejean, Quintal; Christian Peyrot, Annecy le Vieux, both of France

[73] Assignee: Reboul-SMT, Créteil, France

[21] Appl. No.: 193,121

[22] PCT Filed: Jun. 4, 1993

[86] PCT No.: PCT/FR93/00536

§ 371 Date: Feb. 14, 1994

§ 102(e) Date: Feb. 14, 1994

[87] PCT Pub. No.: WO93/25447

PCT Pub. Date: Dec. 23, 1993

[30] Foreign Application Priority Data

Jun. 12, 1992 [FR] France ..... 92 07098

[51] Int. Cl.[6] ..... B67D 5/22

[52] U.S. Cl. ..... 222/47; 222/168; 222/257; 222/380; 222/387; 222/383.3

[58] Field of Search ..... 222/45, 47, 156, 222/168, 380, 321, 383, 386, 387, 257

[56] References Cited

U.S. PATENT DOCUMENTS

| | | | |
|---|---|---|---|
| 4,323,175 | 4/1982 | Eckert | 222/387 |
| 4,684,043 | 8/1987 | Foster et al. | 222/257 |
| 4,715,518 | 12/1987 | Moore | 222/257 |
| 4,793,522 | 12/1988 | Corsette | 222/257 |
| 4,872,596 | 10/1989 | Corsette | 222/380 |
| 4,949,875 | 8/1990 | Kuo | 222/386 |
| 4,967,937 | 11/1990 | von Shuckman | 222/257 |

FOREIGN PATENT DOCUMENTS

| | | |
|---|---|---|
| 686891 | 7/1930 | France . |
| 57554 | 2/1953 | France . |

*Primary Examiner*—Andres Kashnikow
*Assistant Examiner*—Philippe Derakshani
*Attorney, Agent, or Firm*—Hoffmann & Baron

[57] ABSTRACT

Pot comprising a body, a container, and a cover pivoted to the body, characterized in that the container (2, 32), closed by a movable wall (3, 33) insulating the substance from the exterior, communicates with the suction side of an incorporated measuring pump (12–17, 40, 39) which delivers the substance into an incorporated receptacle (15, 56) which is covered at rest by the cover (21, 34); and in that the reversible action of utilization, in a single movement engaging the cover, first of all clears the access to the receptacle and then actuates the pump.

19 Claims, 3 Drawing Sheets

POT FOR THE METERED DISPENSING OF A FLUID SUBSTANCE

BACKGROUND OF THE INVENTION

The present invention relates to the packaging industry and more particularly to the packaging of pumpable substances, such as creams, milks, ointments and other emulsions, gels, more or less thick liquids, in particular for use in pharmaceutics, cosmetics or household maintenance.

Such substances are usually packaged in pots of easily handled sizes having a volume adapted to allow the user to repeatedly take portions of the substance over a more or less long period of time, usually about several weeks. Most often, these pots have a large opening to permit the user to take the product with his fingers. This exposes the substance remaining in the pot to pollutions by the surrounding air and the fingers of the user, and moreover causes evaporation of the more or less volatile components of the packaged substances.

To overcome these drawbacks, it has been proposed to enclose the substances to be distributed in containers having a deformable or movable wall so that the volume of the container gradually diminishes as the substance is taken off without entry of air. In such packages, the user exerts a pressure on the deformable or movable wall so as to expel a more or less variable amount of substance. This is the case of packages in the form of flexible tubes, pots having a piston or a lenticular diaphragm, for example those employed principally for food, hygienic or household maintenance products. Substances are also sold, above all toothpastes, in relatively rigid tubular containers in which the substance is protected from the air by a piston which moves, in the course of the distribution, in accordance with the diminishing volume of the remaining substance. The distribution is achieved by an elastically deformable bulge at the bottom of the container constituting a pump, provided with a check valve. Such a package is disclosed in particular in the German Federal Republic patent No. 1 210 149.

In these conventional packages, the measure of the substance delivered must be received in the hand, or on a brush or other exterior receptacle, which is often impractical since this immobilizes one hand or implies the presence of a nearby table or other support. Further, the distribution orifice is exposed to the air, with risk of deterioration and pollution of the exposed layer of substance. If a detachable cap is provided to avoid this drawback, this requires an additional operation with risk of losing the cap or soiling it if it drops on the floor. It must also be possible to place the cap on a support during the distribution of the substance. It is moreover usually difficult to construct such conventional packages from materials which are sufficiently transparent to enable one to see the level of the substance remaining in the container. Further, in conventional packages, the pump or other distributing means is actuated directly with the finger in the vicinity of the distribution orifice, which involves a risk of soiling the actuating finger with the expelled substance.

An object of the invention is to overcome the drawbacks of packages proposed heretofore and permit the industrial production of packages which are easier and cleaner to use, protect the substance remaining available from any exterior soiling, and possibly indicate the level of the substance in the container.

SUMMARY OF INVENTION

The invention has for subject a distributing-measuring pot for a fluid substance, comprising a body, a container, and a cover pivoted to the body, characterized in that the container, which is closed by a movable wall insulating the substance from the exterior, communicates with the suction side of an incorporated measuring pump which delivers the substance into an incorporated receptacle which is covered at rest by the cover; and in that the reversible action of utilization, in a single movement engaging the cover, first of all clears the access to the receptacle and then actuates the pump.

Such a pot may include an incorporated gauge indicating the level of the substance available in the container by means of a physical element of connection between the movable wall of the container, constituted by a free piston, and a window formed in the body for viewing a part of this connection element.

According to a first embodiment, a pot according to the invention is further characterized in that the cylinder of the pump is disposed transversely above the end wall of the container with which container it communicates through a first duct, under the control of a suction check valve, while a second duct puts the cylinder in communication, under the control of a delivery check valve, with the bottom of a cup-shaped receptacle formed in the upper wall of the body of the pot, while the piston of the pump, which is biased by a return spring to the end of the suction stroke, is extended out of the cylinder by a slidable control rod having a free end, and in that the cover is pivotable in the upper part of the body about an axis perpendicular to the axis of the pump, close to one of the ends of the cover constituting a heel which comes to bear, after a sufficient pivoting of the cover to uncover the receptacle which is at rest covered by a part of the cover remote from the heel, against the end of the piston control rod so as to drive it into the cylinder by continuation of the pivoting, whereby the pump delivers a measure into the receptacle.

In such a pot, the cover may pivot through about 90° before its heel comes to bear against the end of the control rod of the piston by passing through a stop which is capable of being elastically overcome, defines this angular position of the cover before a further pivoting to drive in the piston and opposes an untimely free return of the cover after actuation of the piston.

This cover may advantageously include an extension which comes to block, at rest, the check valve in the bottom of the receptacle, and clipping means which are capable of being overcome, clip the cover at rest in the wall of the body and prevent an untimely opening of the cover.

This first embodiment lends itself particularly well to an aesthetic design characterized in that the body has a spheroidal outer shape in which the cover of complementary outer shape is embedded and yet permits taking hold of its end covering the receptacle.

According to a second embodiment, a pot according to the invention is further characterized in that the container is in the shape of a cylinder of revolution, the cylinder of the pump, which is disposed above and integral with the end wall of the container, is parallel to the axis of the container, and communicates with the interior of the container through a duct under the control of a suction check valve, the piston of the pump, which is biased by a return spring to the end of the suction stroke, is actuated by an outer push member which is mounted on the cylinder and extended toward the piston by an axial rod provided with a duct affording a communication, through the piston, between the interior of the cylinder and the bottom of a cup-shaped receptacle formed in the upper outer side of the push member, under the control of a delivery check valve; in that a cover mounted on the body covers the receptacle at rest, pivots coaxially with the body and is provided with a window which is capable of leaving a free passage for the top of the push member with its receptacle; in that the container is pivotally mounted coaxially in the cover and the body where it is driven in rotation and guided in axial translation by the cover by means of cooperative lugs carried by the cover and the container which come into reciprocal contact in the course of the reversible action of utilization of the pot by a relative pivoting of the body and cover, after a first free angular displacement of the cover bringing the window to a position in facing relation to the push member; in that in the course of the driving of the container in rotation by the cover, an axial translation in the direction toward the cover is imparted to the container by radial studs integral with the container and cooperative with helical grooves formed in the inner wall of the body, in combination with an axial guiding of a radial lug of the container cooperative with an associated longitudinal channel formed in the inner wall of the cover; in that the axial translation of the container causes the push member to project out of the cover until an outer radial stop of the push member comes to bear under the periphery of the window of the cover, continuation of the relative movement of rotation between the cover and the body with an axial translation of the container causing the piston to be driven to the end of the stroke in the cylinder and thereby deliver a measure of substance into the receptacle.

In such a pot, the axial rod of the push member is slidable in a sealed manner through the piston and is provided with an axial passage having a blind end which communicates with a radial passage which is closed by the piston at the end of the suction stroke and is opened when the push member is depressed on the cylinder to the end of the distribution movement, and in that the pump piston is biased inside the cylinder by a return spring to the end of the suction stroke and is biased outside the cylinder by a driving spring which is relatively more resistant to compression than the return spring and bears against the inner side of the push member.

The body may advantageously have an extension inside the cover forming a panel which closes the window of the cover at rest.

The action of utilization can be by means of a relative rotation of the body and cover through about a ½ turn of which about a ¼ turn is for uncovering the window in confronting relation to the push member of the pump, an ⅛ turn is for bringing the push member into abutting relation under the cover with the receptacle jutting out, and an ⅛ turn is for actuating the pump.

It is practical to have the cover carry two lugs for driving the container in rotation which are in the shape of radial fins parallel to the axis of the package and defining therebetween a channel for freely guiding in translation a radial lug carried by the container, the fin driving the lug of the container in rotation with translation toward the cover being longer in the direction parallel to the body than the shorter parallel fin which drives the lug in rotation in the opposite direction with translation toward the bottom of the body.

A better understanding of the invention will be had from the examination and the detailed description of the accompanying drawings which represent two embodiments and a variant of the invention which are chosen merely by way of examples from among many embodiments, adaptations and variants of the invention which may be envisaged by a technician skilled in the art.

DETAILED DESCRIPTION OF THE PREFERRED EMBODIMENTS

Figure 1:
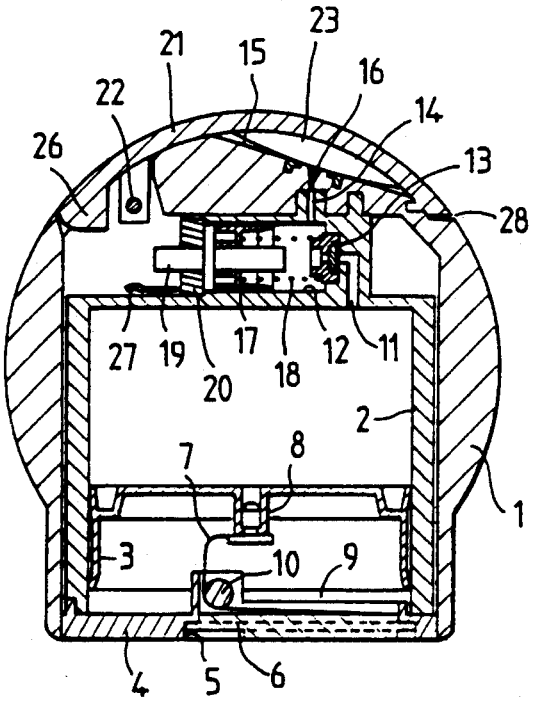
FIG. 1 is a diagrammatic elevational and axial sectional view of a pot according to a first embodiment of the invention, in the position of rest.

In these Figures, corresponding elements are designated by the same reference numerals, sometimes with an index added. The dimensions and the respective proportions of these elements may not have been respected in order to render the drawings more clear.

In a first embodiment of the invention shown in FIGS. 1 to 4, the pot mainly comprises a body 1 having a generally ball outer shape on a short cylindrical base in which is formed a cylindrical cavity in which a cylindrical container 2 is inserted and immobilized, a piston 3 being freely slidable in a sealed manner in this container. The open end of the cylindrical cavity is closed by a bottom wall 4 provided with an elongated opening 5 covered with a transparent plate 6. A flexible band 7 is fixed at one of its ends to an axial spigot 8 which is part of the piston 3, while its free end slides along the transparent plate 6 and is guided laterally by two parallel slideways 9, part of the bottom wall, after having passed round and changed direction at 90° a pin 10 which is also part of the bottom wall. Thus, when the container 2 is full, the piston 3 is close to the bottom wall, the band 7 is visible throughout the length of the opening 5 and, as the container is emptied, the piston rises and pulls along the band so that the extent to which the free end of the band visible in the opening is withdrawn gives an indication of the amount of substance remaining available in the container. The length of the opening 5 substantially corresponds to the travel of the piston 3.

The blind end wall of the container 2 is provided with a duct 11 which axially communicates through a conventional suction check valve 13 with the interior of a pump cylinder 12 provided in an extension of the end wall of the container. A second duct 14, which communicates radially with the interior of the cylinder 12 in the vicinity of the end wall of the latter, connects the cylinder to the base of a cup-shaped receptacle 15 formed in the upper outer wall of the body 1, through a delivery check valve 16 of conventional type in the form of an elastic disc having a central closing spigot surrounded by distribution orifices and fixed by its periphery inserted in the wall around the outlet orifice of the duct 14. A piston 17 is slidable in the cylinder 12 against the action of a return spring 18 which biases the piston to the end of the suction stroke. The piston 17 is extended by an axial control rod having a free end 19 freely slidable through a wall 20 which closes in an unsealed manner the open end of the pump cylinder 12.

A cover 21 having the general shape of a curved strip, is embedded at rest (FIG. 1) in the outer side of the top of the body 1 covering the receptacle 15. It pivots, in the vicinity of its end opposed to the receptacle, about a pin 22 which is perpendicular to the axis of the pump cylinder 12 and is part of the body 1. A web 23 which is part of the inner side of the cover is, at rest, applied against the delivery valve 16 so as to prevent any untimely opening, for example in the case of an atmospheric depression in transit by air. The free end of the cover has a lug 24 which is elastically clipped into a complementary groove 25 formed in the outer side of the top of the body 1 so as to provide a locking of the cover at rest which can be elastically overcome. A free space 28 provided between the free end of the cover and the body permits taking hold of the cover with the finger of the user for pivoting the cover.

Figure 2:
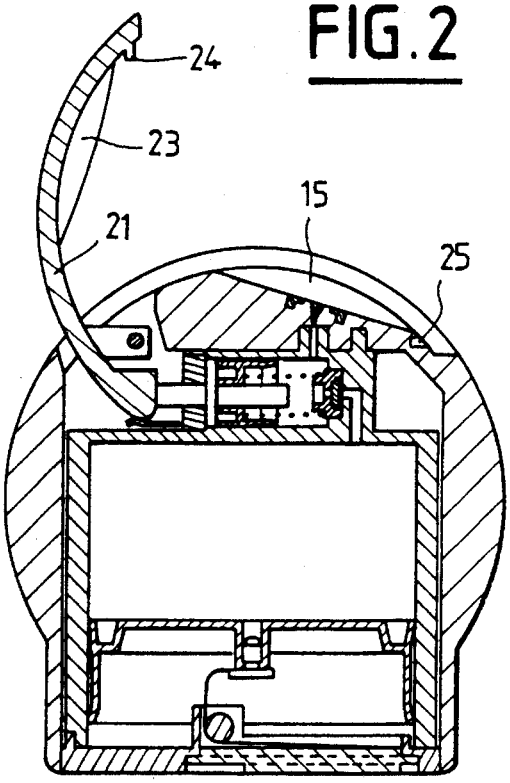
FIG. 2 is a view similar to that of FIG. 1 of the same pot with the cover raised before actuation of the pump.
Figure 3:
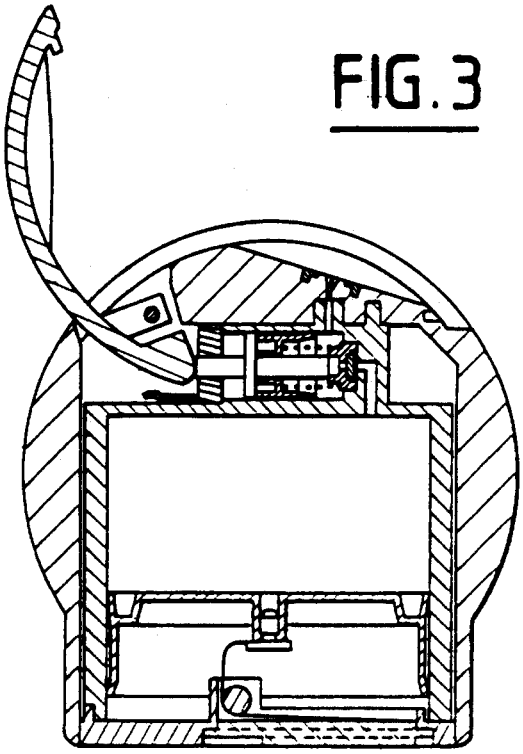
FIG. 3 is a view similar to that of FIGS. 1 and 2 of the same pot at the end of the actuation of the pump.

Beyond its pivoting end, the cover 21 terminates in a heel 26 which, after the cover has pivoted through about 90° about the pin 22, contacts a stop 27, which is capable of being elastically overcome and is fixed to the body, before bearing against the free end of the control rod 19 of the piston of the pump (FIG. 2). Thus, by means of a further pivoting of the cover through about for example 15°, the heel 26 drives the control rod of the piston into the cylinder of the pump and causes a measure of the substance to be delivered into the receptacle 15 (FIG. 3). If the cover is then released, it is returned to the position of contact with the stop 27 (FIG. 2) under the action of the return spring 18 of the piston 17 and this draws in a new measure of substance through the duct 11. With the cover maintained in this position, the user has free access to the receptacle 15 for taking the measure of substance delivered by the pump.

Figure 4:
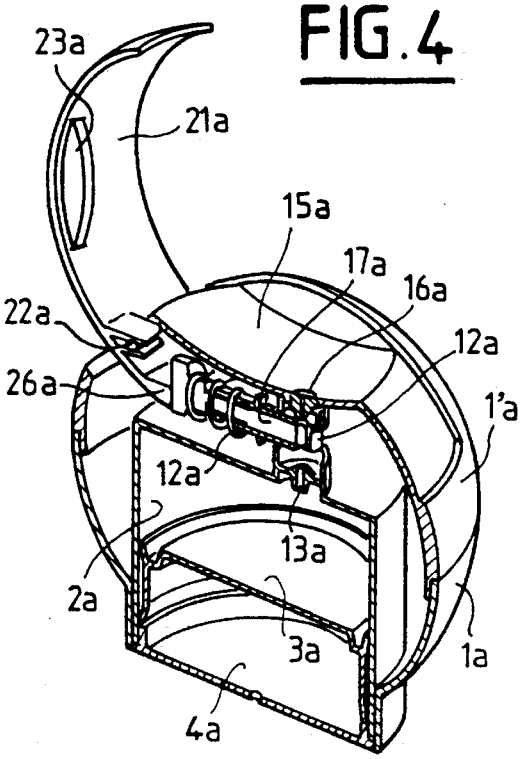
FIG. 4 a ¾ front perspective and diametrical half-sectional view of a variant of the pot of FIGS. 1 to 3, in position for receiving a measure of delivered substance, the cover having returned to the position of FIG. 2.

In the variant shown in FIG. 4, the elements corresponding to those of the pot shown in FIGS. 1 to 3 are designated by the same reference numerals to which the letter a has been added. The same general functional structure of the pot of FIG. 4 is repeated but without the gauge indicating the level of the substance in the container and with a pump having flap valves 13*a*, 16*a* disposed coaxially and transversely of the cylinder 12*a*. The body is moulded in two parts 1*a*, 1'*a* which are welded together.

Figure 5:
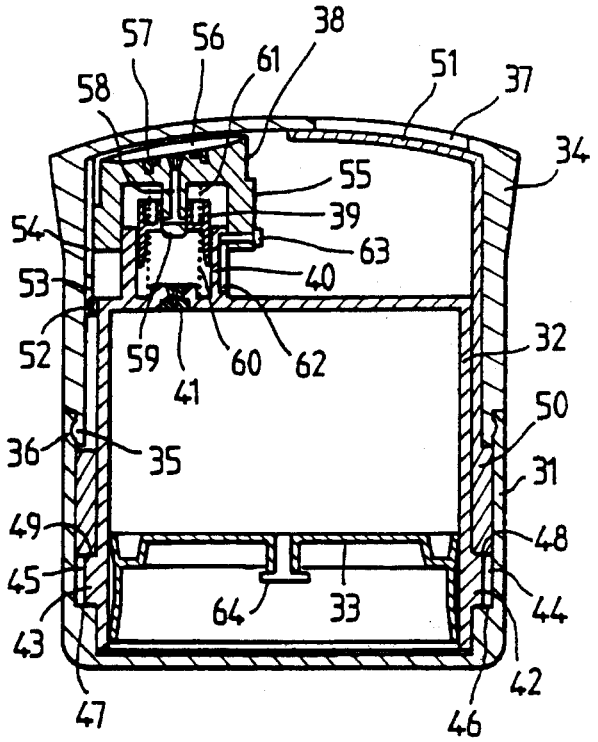
FIG. 5 is a diagrammatic elevational and axial sectional view of a pot according to a second embodiment of the invention, in the position of rest with the window of the cover closed.
Figure 6:
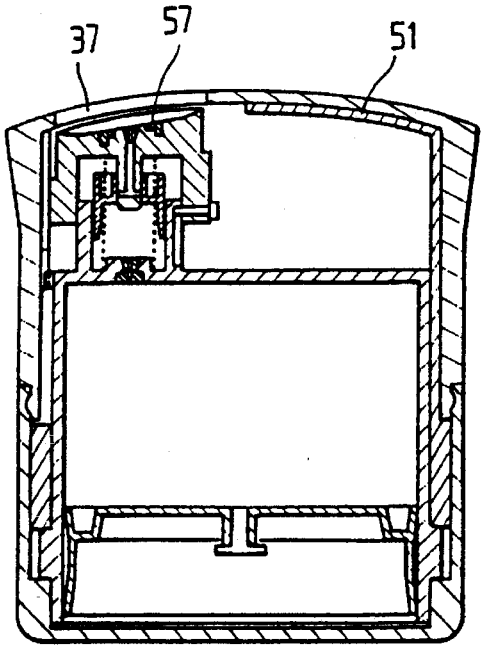
FIG. 6 is a view similar to that of FIG. 5 of the same pot, after rotation through about a ½ turn of the cover relative to the body, with the window of the cover uncovered.

According to the second embodiment shown in FIGS. 5 to 9, the pot mainly comprises a body 31 in the form of a cylindrical cup in which is movable a cylindrical container 32 in which a piston 33 is freely slidable in a sealed manner. A cover 34 in the shape of an inverted cylindrical cup is freely pivotable on the body 31, it being guided by an outer beading 35 on its free end engaged in an inner groove 36 of the open end of the body. The end wall of the cover is provided with an opening 37 which is off axis and is capable of leaving a free passage for the head of a push member 38 for actuating the piston 39 of a pump whose cylinder 40 is off axis and extends the end wall of the container, the cylinder 40 communicating with the interior of the container under the control of a conventional check valve 41. The container 32 has two diametrically opposed outer radial studs 42, 43 in the vicinity of its open end. These studs slide in helical grooves 44, 45 respectively formed between helical edges 46, 47 which project from the inner wall of the body 31 and parallel edges 48, 49 respectively defining the free end of a sleeve 50 connected to the body 31 by welding, adhesion, a drive fit, riveting, or other known means. The opposite end of the sleeve 50 is partly closed by a transverse panel 51 which closes the window 37 of the cover in the position of rest (FIG. 5). The grooves 44, 45 thus form two helical ramps symmetrically offset 180° from each other which impose an axial movement in translation of the container 32 in the body 31 when the container is driven in rotation relative to the latter. This driving is achieved by an outer radial lug 52 projecting from the lateral wall of the container in the vicinity of the end of the latter and cooperating with two radial fins 53, 54 which are parallel to the axis and project from the lateral wall of the cover, these fins forming therebetween a channel for guiding the lug 52 of the container in the axial translation of the container and for driving the latter in rotation. The fin 53 which drives the lug 52 for displacing the container in the direction toward the cover (FIGS. 7, 8) is longer than the fin 54 which drives the lug 52 in the opposite direction for displacing the container in the direction toward the bottom of the body 31.

Figure 7:
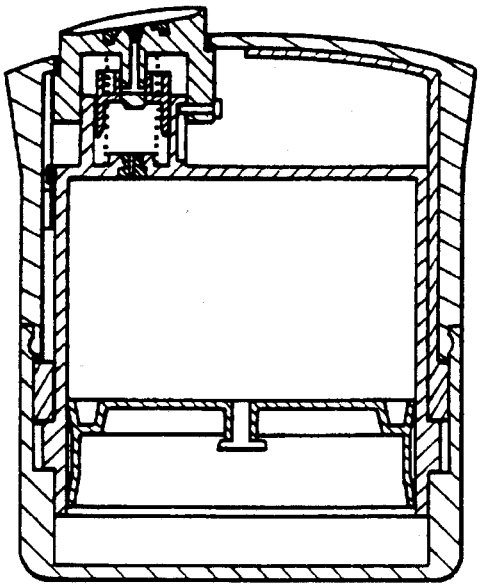
FIG. 7 is a view similar to that of FIG. 6 of the same pot, after an additional turn of about an ⅛ turn of the cover relative to the body, the push member of the pump being as yet unactuated and projecting through the window of the cover.
Figure 8:
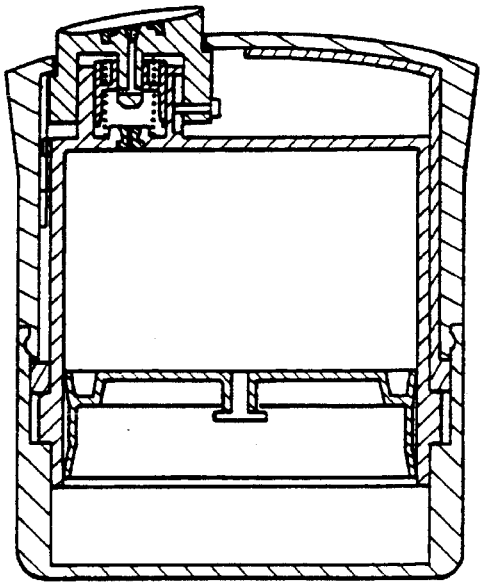
FIG. 8 is a view similar to that of FIG. 7 of the same pot, after a second additional rotation of about an ⅛ turn of the cover relative to the body which has actuated the pump.
Figure 9:
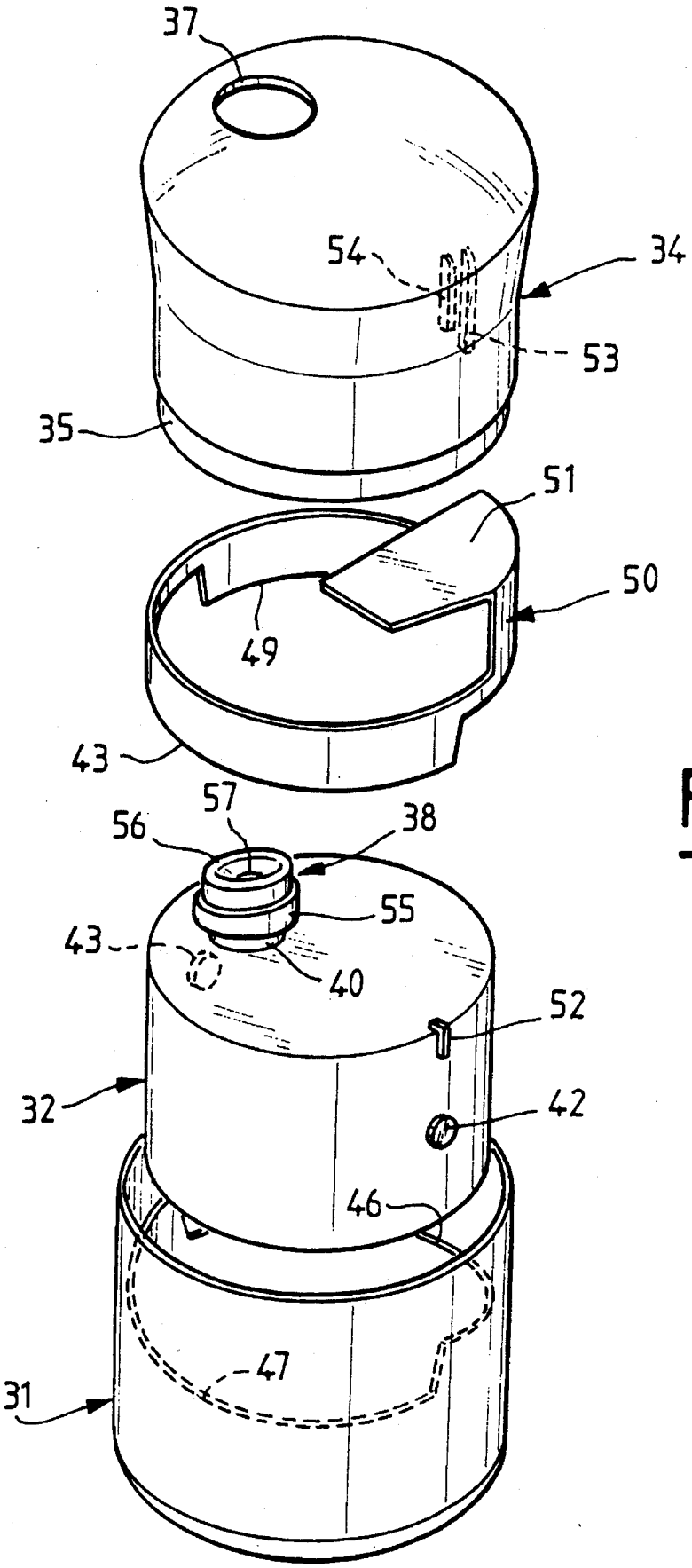
FIG. 9 is a diagrammatic exploded perspective view of the component elements of the pot of FIGS. 5 to 8.

The push member 38 of the pump comprises in its lower part an annular flange 55 which comes to abut against the inner side of the cover 34 along the edge of the window 37 and thus limits the projection of the head of the push member upon the axial translation of the container in the direction toward the cover (FIGS. 7, 8). The top of the head of the push member is provided with a cup-shaped receptacle 56 in the bottom of which is disposed a delivery check valve 57 comprising an elastic disc having peripheral perforations controlling the outlet orifice of an axial duct 58 which extends through an axial rod 59 slidable through the piston 39 in a sealed manner. The duct 58 terminates in the rod 59 in a blind end from which diverge radial passages which are closed by the piston 39 in the position of rest. Inside the cylinder 40, a spring 60 biases the piston 39 to the end of the suction stroke, while the outer surface of the piston is biased by an opposing driving spring 61 which bears against the inner side of the top of the push member 38. The outer lateral wall of the cylinder 40 is provided with a longitudinal groove 60 in which is freely slidable a pin 63 fixed to the push member 40 which prevents the push member from escaping while allowing it free to move axially. The driving spring 61 is stronger in compression than the return spring 60.

The piston 33 of the container is provided with an axial passage closed by a stopper 64 after the container 32 has been filled with the substance to be distributed.

Thus, in the position of rest (FIG. 5), the container 32 is fully inserted in the body 31, it being maintained by its studs 42, 43 in abutting relation to the bottom of the helical grooves 44, 45, the push member 38 is hidden by the cover 34, and the window 37 of the cover is closed by the panel 51. The lug 52 for driving the container is disengaged from the driving fins 53, 54 of the cover.

When the cover 34 is rotated on the body 31, the container 32 does not move until the window 37 comes into alignment with the push member 38 and the fin 53 (the longer fin) of the cover comes to bear against the lug 52 of the container (FIG. 6), which corresponds to a rotation of the cover through about a ½ turn as shown in the drawings in the interest of simplification of the illustration of FIG. 5, but in practice, a ¼ turn is sufficient.

In continuing to rotate the cover on the body, the fin 53 drives the container in rotation by means of its lug 52. The container, guided by its studs 42, 43 in the helical grooves and by its lug 52 in the channel formed between the fins 53, 54, is axially shifted toward the cover until, after a further rotation of the cover through about an ⅛ turn, the annular flange 58 of the push member comes to abut against the inner side of the cover, whereas the head of the push member 38 projects out of the cover (FIG. 7).

A final rotation of the cover through about an ⅛ turn, which brings the container to the end of its axial travel and rotation, causes the push member to be driven downwardly relative to the cylinder 40, first through the piston 39 of the pump by compressing the spring 61 until the opening of the end radial passages of the axial duct 58 of the control rod 59 of the push member, then by driving the piston 39 through the spring 61 by compressing the spring 60. This causes the delivery of a measure of the packaged substance into the receptacle 56 through the valve 57 (FIG. 8).

To close the pot, the cover is rotated on the body in the direction opposed to that of the preceding action. The lug 52 of the container is disengaged from the fin 53 of the cover and is driven in rotation by abutment against (the shorter) fin 54 of the container. The container, guided by its studs in the helical grooves, descends in the body 31 down to the end of the grooves. The fin 53 is then disengaged from the lug 52 and provides the possibility of a last free rotation of the cover bringing its window 37 above the panel 51.

Such a pot may be if desired provided with a gauge similar to that of the first embodiment shown in FIGS. 1 to 3 but, in this case, a connection must be provided between the band and the piston of the container by means of a freely rotatable joint so as to allow the container to rotate relative to the body in the course of the operations, the reading of the gauge being effected at rest with the container fully lowered into the body so as to take into account meaningless variations in the indications due to the displacement of the container together with its piston relative to the end of the body in the course of the operations, which do not represent the real travel of the piston inwardly of the container in the course of the distribution of the packaged substance.

We claim:

1. Distributing-measuring pot for dispensing a fluid substance, comprising a body, a container, an incorporated measuring pump and a cover pivoted to the body, characterized in that the container includes a movable wall in communication with a suction side of the incorporated measuring pump capable of delivering the substance into an incorporated receptacle covered at rest by the cover; a reversible pivot actuation of the cover, initially clears an access to the receptacle and then actuates the measuring pump; and in that the pot includes an incorporated gauge indicating a level of the substance available in the container by means of a physical element of connection between the movable wall of the container and a window formed in the body for viewing a part of said element of connection.

2. Pot as defined in claim 1, wherein a cylinder of the measuring pump is disposed transversely above one end of the container, the container communicating with the pump through a first duct controlled by a suction check valve, while a second duct places the pump in communication, under control of a delivery check valve, with the receptacle formed in an upper wall of the body of the pot, the piston of the pump, which is biased by a return spring at an end of a suction stroke, is extended out of the cylinder by a slidable piston control rod having a free end, and in that the cover is pivotable in the upper part of the body about an axis perpendicular to an axis of the pump, and wherein one end of the cover forms a heel which comes to bear, after a sufficient pivoting of the cover to uncover the receptacle which is at rest covered by a part of the cover remote from the heel, against an end of the piston control rod so as to drive the rod into the cylinder by continuation of the pivoting of the cover, whereby the pump delivers a metered amount of fluid into the receptacle.

3. Pot as defined in claim 2, wherein the cover is pivotable through about 90° before the heel comes to bear against the end of the control rod of the piston by passing through a stop which is capable of being elastically overcome, the stop defining an angular position of the cover before a further pivoting to drive in the piston and oppose an untimely free return of the cover after actuation of the piston.

4. Pot as defined in claim 2, wherein the cover comprises an extension which comes to block, at rest, the delivery check valve positioned in a bottom of the receptacle, and the pot further including clipping means capable of being overcome, the clipping means to clip the cover at rest in a wall of the body and prevent an untimely opening of the cover.

5. Pot as defined in claim 2, wherein the body has a spheroidal outer shape in which the cover of complementary outer shape is embedded.

6. Pot as defined in claim 2, wherein the container is in the shape of a cylinder, and wherein the cylinder of the pump, is disposed above and integral with an end wall of the container, the pump cylinder is parallel to an axis of the container and communicates with the interior of the container through a duct under the control of a suction check valve, the piston of the pump, which is biased by a returning spring to the end of the suction stroke, is actuated by an outer push member which is mounted on the cylinder and extended toward the piston by an axial rod provided with a duct affording a communication, through the piston, between the interior of the cylinder and a bottom of the receptacle formed in an upper outer side of the push member, under the control of a delivery check valve; in that the cover mounted on the body covers the receptacle at rest, pivots coaxially with the body and is provided with a window capable of leaving a free passage for the top of the push member with its receptacle; in that the container is pivotally mounted coaxially in the cover and the body, where it is driven in rotation and guided in axial translation by the cover by means of a cooperative lug carried by the cover and the container which come into reciprocal contact in the course of the reversible cover actuation by a relative pivoting of the body and cover, after a first free angular displacement of the cover bringing the window to a position in facing relation to the push member; in that in the course of the driving of the container in rotation by the cover, an axial translation in the direction toward the cover is imparted to the container by radial studs integral with the container and cooperative with helical grooves formed in the inner wall of the body, in combination with an axial guiding of the cooperative lug of the container cooperative with an associated longitudinal channel formed in an inner wall of the cover; in that the axial translation of the container causes the push member to project out of the cover until an outer radial stop of the push member comes to bear under the periphery of the window of the cover, continuation of the relative movement of rotation between the cover of the body with an axial translation of the container causing the piston to be driven to the end of the stroke in the cylinder and thereby deliver a metered amount of substance into the receptacle.

7. Pot as defined in claim 6, wherein the axial rod of the push member is slidable in a sealed manner through the piston and is provided with an axial passage having a blind end which communicates with a radial passage closed by the piston at the end of the suction stroke and opened when the push member is depressed on the cylinder to the end of the distribution movement, and the pump piston being biased inside the cylinder by the return spring (60) to the end of the suction stroke and being biased outside the cylinder by a driving spring which is relatively more resistant to compression than the return spring and bears against an inner side of the push member.

8. Pot as defined in claim 6, wherein the body has an extension inside the cover constituting a panel which closes the window of the cover at rest.

9. Pot as defined in claim 6, wherein the actuation of the cover comprises a relative rotation of the body and cover through about a ½ turn, of which about a ¼ turn is for uncovering the window in confronting relation to the push member of the pump, an ⅛ turn is for bringing the push member into abutting relation under the cover with the receptacle jutting out, and an ⅛ turn for actuating the pump.

10. Pot as defined in claim 6, wherein the cover includes two lugs for driving the container in rotation, the lugs being in the shape of radial fins parallel to the axis of the container and define therebetween a channel for freely guiding in translation a radial lug carried by the container, the fin driving the lug of the container in rotation with a translation toward the cover being longer in the direction parallel to the body than the shorter parallel fin which drives the lug in rotation in the opposite direction with translation toward the bottom of the body.

11. A pot for metered dispensing of a fluid substance comprising:

a body;

a container housed within said body for holding the substance to be dispensed, the container being closed by at least one movable wall, the container having an outlet thereon;

a measuring pump for delivering a metered amount of substance, said measuring pump having an inlet and an outlet, said inlet communicating with said container outlet;

a receiving surface having an opening communicating with said pump outlet, said receiving surface receiving the metered amount of the substance delivered from the pump through said pump outlet and said receiving surface opening;

a cover pivotally mounted to said body and adapted to have a first position for covering said receiving surface, and a second position for providing clearing access to said receiving surface, said cover being adapted to actuate said pump when pivoted from said first position to said second position.

12. A pot as defined in claim 11, further comprising an incorporated gauge indicating a level of substance available in the container by means of a physical element of connection between the movable wall of the container and a window formed in the body for viewing a part of said element of connection.

13. A pot as defined in claim 12, wherein the movable wall comprises a free piston.

14. A pot as defined in claim 11, wherein the measuring pump includes a piston and a piston control rod, the pump being disposed transversely above one end of the container and the cover being pivotable in an upper part of the body about an axis perpendicular to an axis of the pump, and wherein an end of the cover forms a heel which comes to bear against the piston control rod to drive the rod into the pump piston by actuation of the cover.

15. A pot as defined in claim 14, wherein the cover is pivotable through about 90° before the heel comes to bear against the end of the control rod of the piston, and wherein the cover passes through a stop which is capable of being elastically overcome, the stop defining an angular position of the cover before a further pivoting to drive in the piston, the stop opposing an untimely free return of the cover after actuation of the piston.

16. A pot as defined in claim 11, wherein the receptacle is cup-shaped.

17. A pot as defined in claim 11, wherein the container is in the shape of a cylinder, and wherein the pump includes a piston and a cylinder, the pump cylinder being disposed above and integral with an end wall of the container, the pump cylinder being positioned parallel to an axis of the container and communicating with an interior of the container through a duct under control of a suction check valve, the piston of the pump, being biased by a spring to an end of a suction stroke of the pump, the pump being actuated by an outer push member mounted on the cylinder and extending toward the piston by an axial rod provided with a duct affording a communication, through the piston, between an interior of the cylinder and a bottom surface of the receiving surface of the container, the cover mounted on the body covers the receiving surface at rest, pivots coaxially with the body and is provided with a window capable of leaving a free passage for a top of the push member with the receiving surface, the container being pivotally mounted coaxially in the cover and the body, such that the container is driven in rotation and guided in axial translation by the cover by means of cooperative lugs carried by the cover and the container which come into reciprocal contact in the course of the reversible actuation by a relative pivoting of the body and cover, the container being driven in rotation by the cover such that an axial translation in the direction toward the cover is imparted to the container by radial studs integral with the container and cooperative with helical grooves formed in an inner wall of the body, in combination with an axial guiding of the radial lug of the container cooperative with an associated longitudinal channel formed in an inner wall of the cover such that the axial translation of the container causes the push member to project out of the cover until an outer radial stop of the push member comes to bear under the periphery of the window of the cover, continuation of the relative movement of rotation between the cover of the body with an axial translation of the container causing the piston to be driven to the end of the stroke in the cylinder and thereby deliver a metered amount of substance into the receptacle.

18. A pot as defined in claim 17, wherein the axial rod of the push member is slidable in a sealed manner through the piston and is provided with an axial passage having a blind end which communicates with a radial passage closed by the piston at the end of the suction stroke and opened when the push member is depressed on the cylinder to the end of the distribution movement, and the pump piston being biased inside the cylinder by the return spring to the end of the suction stroke and being biased outside the cylinder by a driving spring which is relatively more resistant to compression than the return spring and bears against an inner side of the push member.

19. A pot as defined in claim 17, wherein the actuation of the cover comprises a relative rotation of the body and cover through about a ½ turn, of which about a ¼ turn is for uncovering the window in confronting relation to the push member of the pump, an ⅛ turn is for bringing the push member into abutting relation under the cover with the receptacle jutting out, and an ⅛ turn for actuating the pump.

* * * * *